US005490865A

United States Patent [19]

Scheiwiller

[11] Patent Number: 5,490,865

[45] Date of Patent: Feb. 13, 1996

[54] METHOD OF TREATING AND DYEING ANIMAL FIBERS

[76] Inventor: Jurg P. Scheiwiller, Audresser, SA rue du Port, BP 119 27401 Louviers Cedex, France

[21] Appl. No.: 279,529

[22] Filed: Jul. 25, 1994

[51] Int. Cl.[6] ..... D06P 3/00; D06P 5/00

[52] U.S. Cl. ..... 8/404; 8/478; 8/481; 8/585; 8/602; 8/94.1 R; 8/930

[58] Field of Search ..... 8/404, 478, 481, 8/585, 604, 618, 635, 94.1 R, 94.25, 94.26, 94.27, 930, 602

[56] References Cited

U.S. PATENT DOCUMENTS

| | | | |
|---|---|---|---|
| 484,080 | 10/1892 | Zillessen | 8/481 |
| 670,959 | 4/1901 | Kick | 8/481 |
| 689,559 | 12/1901 | Meyer | 8/481 |
| 815,671 | 3/1906 | Becke | 8/481 |
| 1,913,410 | 6/1933 | Rivat | 8/454 |
| 2,726,133 | 12/1955 | Helfenberger et al. | 8/127.5 |
| 3,310,361 | 3/1967 | Stewart | 8/15 |
| 3,775,045 | 11/1973 | Buehler et al. | 8/15 |
| 3,986,829 | 10/1976 | Schäfer et al. | 8/115.7 |
| 4,492,585 | 1/1985 | Prevel | 8/493 |
| 4,830,632 | 5/1989 | Lauton | 8/94.25 |

*Primary Examiner*—Paul Lieberman
*Assistant Examiner*—Caroline L. Dusheck

[57] ABSTRACT

The present invention is a process for producing two-tone or multi-color effects on animal fibers and the products derived from these fibers. Pretreatment of the fibers to increase the affinity of the fiber relative to metallic salts or dyes for is accomplished by treatment with an ethanolamine solution containing varying amounts of mono-, di-, or triethanolamine. A mordant treatment with a metallic salt exposes the pretreated fibers to an aqueous solution of organic acids and a metallic salt mordant having affinity for the pretreated fiber. The two-tone or multi-colored effect is achieved by combining the treated fibers with untreated fiber and dyeing the fibers in a dyestuff having affinity for the treated fiber. The dyeing process may also include placing treated and untreated fibers in a dye bath containing dye stuffs that have affinity to treated fibers and dyestuffs that have an affinity to untreated fibers.

15 Claims, No Drawings

METHOD OF TREATING AND DYEING ANIMAL FIBERS

The present invention relates generally to the field of textile dyeing and more specifically to a dyeing process for producing multi-color effects on animal fiber containing keratin and the product thereof.

BACKGROUND OF THE INVENTION

Multi-color effects in textiles have heretofore been obtained either by blending colored raw material prior to spinning or by using dyed yarn of different colors in weaving, knitting or twisting. Another known procedure is to blend raw fibers of different compositions together, then place them in a single dye bath to obtain a multi-color effect. The different compositions will dye differently creating a two tone or multi-colored effect. Other procedures allow obtaining a tone on tone effect of differential shading by applying a special treatment, such as acetylation, on one part of fibers contained in the yarn, prior to spinning which prevents the treated fiber from taking up certain dyestuffs.

Another way to obtain two tone or multi-colored effects is by increasing the affinity of some of the fibers with respect to certain dyestuffs. One such procedure increases affinity by a chlorination treatment. Other procedures to affect dye affinity of fibers to certain dyestuffs use strongly acidic or alkaline baths. Still other treatment procedures use oxidizing treatments with metallic salts.

Another known treatment for obtaining multi-colored effects on fiber material uses a chrome based mordant to treat fibers that are then blended with untreated fibers. The known procedures for using a chrome based mordant do not fix the mordant to the fibers well. This results in the presence of residual mordant in the bath, which in turn lessens the desired two tone coloring effect.

The known two tone or multi-color dyeing procedures do not produce a highly distinct color differentiation. In addition, these treatments required to produce two-tone or multi-colored effects adversely react with the fibers causing damage to the fibers.

The present invention enables dyeing fibers of the same composition in a single bath to obtain a two tone or multi-color effect without use of mineral reducing agents or other chemicals that harm the quality of the fiber. The fixation of a mordant to the pretreated fibers in the present invention is substantially complete to the extent that no residual dye remains in the dye bath to effect the coloring of untreated fiber, allowing superior light fastness, reproducibility, and contrast.

SUMMARY OF THE INVENTION

The present invention is a process for producing two-tone or multi-color effects on animal fibers containing keratin, and the products derived from these fibers. The invention involves a two step treatment process prior to dyeing. The first step involves a lo pretreatment of the fibers to increase the affinity of the fiber relative to metallic salts or dyes for keratin containing animal fibers by treatment with an ethanolamine solution containing varying amounts of mono-, di-, or triethanolamine. The second step is a mordant treatment with a metallic salt involving exposing the pretreated fibers to an aqueous solution of organic acids and a metallic salt mordant having affinity for the pretreated fiber. The two-tone or multi-colored effect is achieved by combining the treated fibers with untreated fiber and dyeing the fibers in a dyestuff having affinity for the treated fiber. The dyeing process may also include placing treated and untreated fibers in a dye bath containing dye stuffs that have affinity to treated fibers and dyestuffs that have an affinity to untreated fibers.

DETAILED DESCRIPTION OF THE INVENTION

The present invention allows dyeing of keratin containing animal fibers to achieve a multi-colored effect by exposing animal fibers or goods derived from animal fibers such as yam, woven cloth or garments comprised of treated and untreated fibers in a single dye bath. The dye bath can contain different dyes having affinity for the treated or untreated fiber as desired, or a single dye having affinity for the treated fiber. Printing on cloth or garments is easily and economically achieved by this single dye bath process in conventional equipment.

Fibers are treated in two stages prior to dyeing: a pretreatment with an ethanolamine solution to increase the affinity of the fibers to metallic salts and dyes for animal fibers containing keratin and a mordant treatment with a metallic salt.

The pretreatment uses mono-, di-, or triethanolamine to react with the amino acids of the animal fibers. The ethanolamines are strongly alkaline which will cause breaks in the amino acids. The breaking allows greater fixation or absorption of metallic salts or dyes for wool.

The pretreatment phase may be completed using standard dye equipment. The procedure uses a bath of about 1 to 10 grams ethanolamine per liter soft water at room lo temperature and preferably about 2 to 4 grams of triethanolamine per liter of soft water. The soft water is preferably free of salts. The bath is then heated to a temperature between about 80° and 100° C. for about 20 to 60 minutes at a pH between about 9 and 11 and preferably about 90° C. at a pH between about 9 and 10. The fibers are then rinsed with soft water until the water rinsed from the fibers is clear.

A mordant is then applied to the fibers. The mordant uses a soluble metallic salt, examples of which are iron, aluminum, tin, nickel or chrome in the form of a sodium salt, potassium salt or derivative of an organic acid, preferably from the group consisting of acetic, formic, citric, tartic and lactic acids. The mordant requires adding organic acids to the dye bath to act as neutral reducing agents. Mineral reducing agents can thereby be avoided in the mordant treatment, substantially reducing damage to the fibers, and preserving the qualities of the fibers relative to prior mordant applications using mineral reducing agents.

The application of the mordant is achieved using standard dyeing equipment. The total time for the application is preferably between about 80 and 100 minutes, with the pH preferably starting at about 4 and ending at about 3. To a bath of soft water heated to between 20° and 40° C. is added to the bath about 2 grams of acetic acid per liter of soft water and about 1 to 2 % of fiber weight of the soluble metallic salt, preferably potassium dichromate. The temperature of the bath is heated to between about 95° and 100° C. over a period of about 20 to 40 minutes and is maintained at that temperature for about 15 to 30 minutes. Formic and lactic acids are then added to the bath to act as neutral reducing agents. The formic acid is added in an amount of about 2 to 3 grams per liter, the temperature being maintained at about 95° to 100° C. for about 15 minutes. The lactic acid is then added in an amount of about 4 to 6 grams per liter, and the bath maintained at 95° to 100° C. for about 20 to 40 additional minutes, preferably at about 100° C. The fibers are then rinsed with soft water and dryed.

Fixation of the mordant in the present invention is substantially complete, allowing for vivid shades and contrasts and superior reproducibility. Substantially no metallic salt residuals are found in the exhausted effluent, allowing for greater leveling of shades.

The dyeing procedure uses a dye having affinity for the fibers treated with the metallic salts. The untreated fibers may be kept natural or dyed with an acid or reactive dye.

The dyeing process consists of adding the following chemicals to a dye bath of soft water at about room temperature: about 1 to 5 grams per liter of an oxyethylene derivative of a fatty alcohol, a fatty acid, an aliphatic or an aromatic compound with a high muddy point of about 90°–100° C.; 1 to 5 grams per liter of an 80% acetic acid solution; about 0.2 to 0.8 grams per liter EDTA (tetrasodium ethylenediaminetetraacetate); about 3 to 10 grams per liter urea; and 5 to 20 grams per liter sulfate or sodium chloride. Oxyethylene derived from a fatty alcohol may be used in an amount of 1 to 2 g/l. The temperature of the dye bath is increased from about room temperature to about 40° C. over a 15 minute period. Chrome dye is added in an amount in relation to the weight of the treated fibers. An acid or reactive dye is added in an amount in relation to the total weight of the treated and untreated fibers. The temperature of the dye bath is increased to about 100° C. and is maintained for about 30 to 45 minutes.

The EDTA makes the metallic salts soluble. It possesses a bivalent action in a weak acid environment which permits the uptake of dyes and metallic complexes in the bath. The urea is used as an activator.

A chrome mordant with a chrome dye may be used in the process. A fatty oxylenic alcohol in the amount of about 1 to 2 grams per liter of soft water may be used. About 1.5 to 3 grams per liter of an 80% solution of acetic acid is preferred. The EDTA is a 40% solution and about 0.3 to 0.6 grams per liter may be used. The urea may be added in an amount of about 3 to 5 grams per liter. Sodium chloride may be used in the amount of about 8 to 12 grams per liter.

Example 1 is illustrative of the treatment of the present invention and is not intended to be limiting. Further examples and modifications may occur to one skilled in the art and these examples and modifications are intended to be included within the scope of this invention.

EXAMPLE 1

Australian wool of 22.5μ is prepared by scouring with trichlorethane to control by extraction a grease content of 0.6%. The wool is wetted in a bath of cold soft water with a ratio of one part wool to 10 parts water for a period of 15 minutes, then drained.

The wool is then subjected to the first stage of treatment, the pretreatment, to increase the dye affinity. The bath of soft water is increased to 25° C. and 3 g/l of $C_6H_{15}O_3N$ (triethanolamine) is added, obtaining a pH of about 9 to 10. While circulating the bath, the temperature is increased to 90° C. during a period of 30 minutes, and maintained at that temperature for an additional 30 minutes. The pretreated wool is then drained and rinsed with an abundant amount of soft water.

The application of the mordant to the pretreated wool is accomplished in a bath of soft water at a temperature of 30° C. Three g/l of an 80% solution of $CH_3COOH$ (acetic acid) and 1% of the dry fiber weight of $K_2Cr_2O_7$ (potassium dichromate) are added to the bath. During a period of 30 minutes, the temperature of the bath is increased to 100° C., and maintained at that temperature for 20 minutes at a pH of 4.

After the bath has been maintained at 100° C. for 20 minutes, 2 g/l of HCOOH (formic acid) is added and the temperature is maintained at 100° C. for an additional 15 minutes at a pH of 3.2. At the end of the 15 minute period, 5 g/l $C_3H_6O_3$ (lactic acid) is added to the bath, the temperature is maintained at 100° C. and pH is maintained at 3.2 for another 30 minutes. The bath is then drained and the wool is rinsed with an abundant amount of soft water and dried. The treated fibers will appear light grey/greenish in color.

The dyeing of yarn, woven cloth or garments in accordance with the present invention is performed on goods having both treated and untreated fibers. It is preferred that the fibers are free of metallic salts other than the mordant.

Chrome dye is used in the dyeing process in an amount in relation to the weight of the treated fiber. The treated fibers will exhibit an increased affinity to the chrome dye. Acid or reactive dyes can also be used in the single dye bath. The acid or reactive dyes are used in an amount in relation to the total weight of treated and untreated fibers. The untreated fiber will exhibit an affinity for the acid or reactive dyes while the treated fiber exhibits affinity for the chrome dye, thereby producing a multi-color or two-tone effect. Where chrome dye is the only dyestuff used in the process, a two-tone effect will be achieved as the untreated fiber will remain virtually uncolored or appear ecru or natural.

Example 2 is illustrative of the dyeing process of the present invention and is not intended to be limiting.

EXAMPLE 2

The dyeing process may, for example, be used on a yarn WC 1/24 having 50% untreated and 50% treated fiber blended together. The yarn is wound on dye cones of 2 lbs each, and the cones are inserted into an autoclave. The bath ratio is 1/9. Standard commercial dyeing equipment may be used. Alternatively, an open kettle with adequate circulation could be employed.

Scouring of the yarn is accomplished in preparation for dyeing in a soft water solution of 1 g/l of a non-ionic condensed ethylene oxide or fatty alcohol and 1 g/l of a 20% solution of ammonia. The bath is then drained and the yarn is rinsed with cold soft water.

Dyeing is accomplished in a bath of soft water. The bath is brought to a temperature of 20° C. To the bath is added 1.5 g/l of fatty oxylenic alcohol with a high muddy point, 2 g/l of an 80% solution of $CH_3COOH$ (acetic acid), 0.5 g/l of a 40% solution of EDTA, 5 g/l $CH_4ON_2$ (UREA), and 10 g/l $Na_2SO_4$, all of which can be added directly or previously dissolved. The bath is circulated and the temperature increased to 40° C. during a period of 15 minutes, during which time the dyestuff is added.

The dyestuff, chrome blue no. 1 at a ratio of 1% of the mordant treated fiber weight, is prepared and dissolved in hot water. Reactive dye for wool yellow at a ratio of 0.1% of the total weight of treated and untreated fiber is also prepared and dissolved in the hot water. The hot water solution is added to the circulating bath.

The temperature of the bath containing the dyestuff is increased to 100° C. during a period of 20 minutes, and this temperature is maintained for 30 to 45 minutes. The pH of the bath should be about 4. A small quantity of an 80% solution of acetic acid may be added to the bath to maintain a pH of 5 or lower.

The dyestuff will be fully fixed on the fibers and the bath exhausted when the bath solution is clear. The bath is then drained and the fibers rinsed with an abundant amount of soft water. A soft water solution having 1 g/l of an 80% solution of $CH_3COOH$ may be used for finishing. The cones are then taken out of the dyeing equipment and dried.

The dyed fibers will have a chine effect with the treated wool a strong blue and the untreated wool a yellow.

Further examples and modifications may occur to one skilled in the art and these examples and modifications are intended to be included within the scope of this invention.

What is claimed is:

1. A process for producing multi-color effects on animal fiber comprising a pretreatment step comprising exposing animal fiber to an aqueous ethanolamine solution to form pretreated fiber;

a treatment step comprising exposing the pretreated fiber to a treatment solution comprising lactic acid and a mordant having affinity for the pretreated fiber to form treated fiber;

a combining step comprising combining the treated fiber with fiber that has not been treated to form combined fiber; and dyeing step comprising exposing the combined fiber to a dye bath comprising urea and EDTA and a dyestuff having affinity for the treated fiber.

2. A process for producing multi-color effects on animal fiber as claimed in claim 1 wherein the aqueous ethanolamine solution of the pretreatment step is at least one of mono-, di- and triethanolamine.

3. A process for producing multi-color effects on animal fiber as claimed in claim 1 wherein the pretreatment step further comprises heating the aqueous ethanolamine solution from a temperature of about 25° C. to about 80° to about 100° C. during a period from about 20 to about 40 minutes;

wherein the aqueous ethanolamine solution is at a concentration of from about 1 to about 10 g/l of soft water; and maintaining the temperature of the aqueous ethanolamine solution at a range from about 80° to about 100° C. for about 20 to about 60 minutes, the solution having a pH of about 9 to about 11.

4. A process for producing multi-color effects on animal fiber as claimed in claim 3 wherein the amount of ethanolamine is from about 2 to 4 g/l soft water.

5. A process for producing multi-color effects on animal fiber as claimed in claim 3 wherein the heating of the aqueous ethanolamine solution is to a temperature of about 90° C.

6. A process for producing multi-color effects on animal fiber as claimed in claim 3 wherein the pH is between about 9 and 10.

7. A process for producing multi-color effects on animal fiber as claimed in claim 1 wherein the mordant is a metallic salt.

8. A process for producing multi-color effects on animal fiber as claimed in claim 7 wherein the mordant is a chrome salt.

9. A process for producing multi-color effects on animal fiber as claimed in claim 8 wherein the dyestuff is a chrome dye.

10. A process for producing multi-color effects on animal fiber as claimed in claim 1, wherein the treatment step fur,her comprises the following steps being completed in about 80° to about 100° C.:

heating the treatment solution to a temperature of about 20° to about 40° C.;

adding about 2 g/l acetic acid to the treatment solution;

adding about 1 to about 2% by weight of potassium dichromate to the treatment solution;

increasing the temperature of the treatment solution to about 95° to about 100° C. during a period from about 20 to about 40 minutes;

maintaining the temperature of the treatment solution at about 95° to about 100° C. for about 15 to about 30 minutes;

adding about 2 to about 3 g/l of formic acid to the treatment solution;

maintaining the temperature of the treatment solution at about 100° C. for about 15 minutes;

wherein the lactic acid is in an amount from about 4 to about 6 g/l; and maintaining the temperature of the treatment solution at about 95° to about 100° C. for about 20 to about 40 minutes, the solution having a pH of about 3 to about 4.

11. A process for producing multi-color effects on animal fiber as claimed in claim 1 wherein the dyeing step further comprises adding a dyestuff having affinity for the fiber that has not been treated.

12. A process for producing multi-color effects on animal fiber as claimed in claim 1, wherein the dyeing step further comprises:

adding animal fiber to a dye bath having a neutral pH;

adding about 1 to about 5 g/l of an oxyethylene to the dye bath;

adding about 1.5 to about 3 g/l acetic acid to the dye bath;

adding about 0.3 to about 0.6 g/l tetrasodium ethylenediamine-tetraacetate to the dye bath;

adding about 3 to about 10 g/l urea to the dye bath;

adding about 0.8 to about 12 g/l sodium sulfate to the dye bath;

increasing the temperature of the dye bath to about 40° C. for about 15 minutes; and adding the dyestuff.

13. A process for producing multi-color effects on animal fiber as claimed in claim 12 wherein the amount of urea is about 3 to 5 g/l.

14. A process for producing multi-color effects on animal fiber as claimed in claim 12, wherein the dyeing step further comprises:

circulating the dye bath for about 15 minutes after adding dyestuff;

increasing temperature of the dye bath from about 90° to about 100° C. during a period of about 20 minutes; and maintaining the temperature of the dye bath at from about 90° to about 100° C. for about 30 to about 45 minutes;

the dye bath having a pH of about 4 to about 5.

15. Animal fibers having multi-color effects obtained by the process comprising the process as claimed in claim 1.

* * * * *